US011002162B2

(12) United States Patent
Emmersberger et al.

(10) Patent No.: US 11,002,162 B2
(45) Date of Patent: May 11, 2021

(54) VALVE DRIVE FOR AN INTERNAL COMBUSTION ENGINE

(71) Applicant: Bayerische Motoren Werke Aktiengesellschaft, Munich (DE)

(72) Inventors: Georg Emmersberger, Pfaffing (DE); Dietmar Knoll, Feldkirchen (DE); Roland Kraft, Unterschleissheim (DE); Rudolf Schmid, Riemerling (DE); Thomas Steinle, Munich (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 16/797,169

(22) Filed: Feb. 21, 2020

(65) Prior Publication Data

US 2020/0191025 A1 Jun. 18, 2020

Related U.S. Application Data

(63) Continuation of application No. PCT/EP2018/069085, filed on Jul. 13, 2018.

(30) Foreign Application Priority Data

Aug. 24, 2017 (DE) ..... 10 2017 214 793.8

(51) Int. Cl.
*F01L 13/00* (2006.01)
*F01L 1/053* (2006.01)
(Continued)

(52) U.S. Cl.
CPC ..... *F01L 13/0036* (2013.01); *F01L 1/053* (2013.01); *F01L 1/185* (2013.01);
(Continued)

(58) Field of Classification Search
CPC ..... F01L 2001/0473; F01L 2001/0476; F01L 1/053; F01L 13/0036; F01L 2013/0052
(Continued)

(56) References Cited

U.S. PATENT DOCUMENTS 5,129,407 A * 7/1992 Phillips ..... F01L 13/0036 123/90.18
5,359,970 A 11/1994 Krebs
(Continued)

FOREIGN PATENT DOCUMENTS

DE 10 2004 022 833 A1 12/2005
DE 10 2005 006 489 A1 8/2006
(Continued)

OTHER PUBLICATIONS

International Search Report (PCT/ISA/210) issued in PCT Application No. PCT/EP2018/069085 dated Sep. 24, 2018 with English translation (five (5) pages).
(Continued)

*Primary Examiner* — Jorge L Leon, Jr.
(74) *Attorney, Agent, or Firm* — Crowell & Moring LLP

(57) ABSTRACT

A valve drive for a cylinder head of an internal combustion engine has a first camshaft which is rotatably mounted in a first and a second camshaft bearing and which includes at least one cam with a first cam curve and a second cam curve that differs from the first cam curve. A gas exchange valve is actuated by the first or the second cam curve. A camshaft section is provided, by which the cam can be moved by an actuator such that the gas exchange valve can be actuated either via the first or the second cam curve. The first camshaft and the cam have a fixed position relative to each other. The first camshaft can be axially moved in the first and the second camshaft bearing, and an axial lock is provided for the camshaft.

4 Claims, 3 Drawing Sheets

(51) Int. Cl.
*F01L 1/18* (2006.01)
*F01L 1/047* (2006.01)

(52) U.S. Cl.
CPC ..... *F01L 2001/0471* (2013.01); *F01L 2001/0476* (2013.01); *F01L 2013/0052* (2013.01)

(58) Field of Classification Search
USPC ..... 123/90.18, 90.27
See application file for complete search history.

(56) References Cited

U.S. PATENT DOCUMENTS

| | | | | |
|---|---|---|---|---|
| 2012/0279467 | A1 | 11/2012 | Scherzinger et al. | |
| 2012/0285408 | A1* | 11/2012 | Richter | F01L 13/0036 123/90.17 |
| 2013/0306014 | A1* | 11/2013 | Stolk | F01L 13/0036 123/90.18 |
| 2015/0101552 | A1* | 4/2015 | Choi | F02D 13/0211 123/90.15 |
| 2016/0090875 | A1* | 3/2016 | Choi | F01L 1/344 123/90.11 |
| 2016/0090921 | A1 | 3/2016 | Choi | |
| 2016/0265397 | A1* | 9/2016 | Schulz | F01L 13/0036 |
| 2019/0010839 | A1* | 1/2019 | Tsunoda | F01L 13/00 |

FOREIGN PATENT DOCUMENTS

| | | | |
|---|---|---|---|
| DE | 10 2007 061 353 | A1 | 6/2009 |
| DE | 10 2009 057 633 | B3 | 3/2011 |
| DE | 10 2013 111 410 | A1 | 4/2015 |
| DE | 10 2015 012 287 | A1 | 3/2017 |
| DE | 10 2016 200 424 | A1 | 7/2017 |
| DE | 10 2016 206 060 | A1 | 10/2017 |
| DE | 10 2016 208 392 | A1 | 11/2017 |
| EP | 0 595 060 | A1 | 5/1994 |
| WO | WO 2012/079794 | A1 | 6/2012 |

OTHER PUBLICATIONS

German-language Written Opinion (PCT/ISA/237) issued in PCT Application No. PCT/EP2018/069085 dated Sep. 24, 2018 (five (5) pages).

German-language Search Report issued in counterpart German Application No. 10 2017 214 793.8 dated Jun. 14, 2018 with partial English translation (13 pages).

* cited by examiner

VALVE DRIVE FOR AN INTERNAL COMBUSTION ENGINE

CROSS REFERENCE TO RELATED APPLICATIONS

This application is a continuation of PCT International Application No. PCT/EP2018/069085, filed Jul. 13, 2018, which claims priority under 35 U.S.C. § 119 from German Patent Application No. 10 2017 214 793.8, filed Aug. 24, 2017, the entire disclosures of which are herein expressly incorporated by reference.

BACKGROUND AND SUMMARY OF THE INVENTION

The invention relates to a valve drive for a cylinder head of an internal combustion engine.

Regarding the technical background, reference is made, for example, to European patent application EP 0 595 060 A1. This patent application discloses a valve drive of an internal combustion engine, which valve drive has prestressed sliding cams which can be displaced axially on a camshaft. From a first position, in which they act with a first lift lobe on inlet valves, the sliding cams can be displaced into a second position, in which they act with a second lift lobe on the inlet valves. In the first position, the sliding cams bear in an integrally joined manner against a stop of a transmission element which is connected between the inlet valves and the sliding cams, as long as they run with one section in the region of the stop. When the base circle of the sliding cams is reached, they are displaced into the second position.

A further example of sliding cams is known, for example, from German laid open specification DE 10 2005 006 489 A1. This is a camshaft arrangement which has a basic shaft and cam carriers which are arranged on it, can be displaced axially but are held fixedly so as to rotate with the basic shaft. Here, cams with a plurality of cam lobes are configured on the cam carriers, which cams in each case have a common base circle and different cam lobes which have different lobe profiles than one another. Valve actuating means of associated cylinders are actuated by way of the cams. Actuators for carrying out switchover operations are provided, a different one of the cam lobes of the cam coming into contact with the valve actuating means in the case of the switchover operations by way of axial displacement of cam carriers on the basic shaft.

German laid open specification DE 10 2004 022 833 A1 discloses a further valve drive for an internal combustion engine. The valve drive comprises a camshaft with a sliding cam device which has cam tracks, which lie next to one another and act on valves, with different cam shapes and lift lobes, which lift lobes interact with actuating elements which have control pins for the adjustment of the sliding cam device.

Furthermore, reference is made to German patent specification DE 10 2009 057 633 B3. This patent specification discloses a method for producing an assembled camshaft, a camshaft main body and an assembled camshaft. The method produces an assembled camshaft with at least one cam element which is arranged on a camshaft main body fixedly so as to rotate with it but such that it can be displaced axially, and with at least one cam element which is arranged on the camshaft main body fixedly so as to rotate with it and such that it cannot be displaced axially. The method has the following steps:

providing a rod-shaped camshaft main body, machining the camshaft main body by way of surface machining of the camshaft main body in at least one first axial part section by way of the production of an outer surface profile which extends in the axial direction, surface machining of the camshaft main body in at least one second axial part section which is mounted downstream of the first part section as viewed in a predefined threading direction, by way of widening of the camshaft main body to a widened external diameter at least in regions, providing a plurality of cam elements with a hub cross section and an inner surface profile which extends in the axial direction and correlates with the outer surface profile of the camshaft main body, the hub cross section having a minimum internal diameter which is dimensioned to be smaller than the maximum external diameter in the second part section of the camshaft main body, assembling the cam elements, at least one first cam element being pushed onto the camshaft main body in the threading direction over the at least one first axial part section as far as in front of the widened region of the at least one second axial part section, the cam element which has been pushed on being oriented with a precise angle with respect to a predefined reference position of the camshaft main body and being connected to the camshaft main body in a positively locking manner by way of a subsequent axial relative movement between the cam element and the camshaft main body, and subsequently at least one second cam element being pushed onto the camshaft main body in an angularly oriented manner in the threading direction as far as the at least one first part section, and being positioned there fixedly so as to rotate with said camshaft main body but such that it can be displaced axially.

Disadvantages of the abovementioned valve drives are their complicated and expensive production, and disruptive acoustic effects during operation of the internal combustion engine on account of the axial spline system which is subject to tolerances.

It is an object of the present invention to avoid the abovementioned disadvantages. It is a further object of the present invention to prevent an axial displacement of the camshaft during operation of the internal combustion engine.

This and other objects are achieved by a valve drive for a cylinder head of an internal combustion engine. The valve drive has a first camshaft, which is mounted rotatably in first and second camshaft bearings, with at least one cam with a first cam lobe and a second cam lobe which is different than the first cam lobe. It is possible for a gas exchange valve to be actuated by way of the first or the second cam lobe. A camshaft section is provided, by way of which the cam can be displaced via an actuator in such a way that the gas exchange valve can be actuated either via the first or the second cam lobe. The first camshaft and the cam have a fixed position with respect to one another, and the first camshaft can be displaced axially in the first and the second camshaft bearing, an axial lock being provided for the camshaft.

On account of the single-piece, axially displaceable camshaft, the manufacturing costs are reduced substantially and the acoustic problems are avoided because of the absence of the axial spline system. Furthermore, on account of the proposed axial locking, a relative movement of the camshaft with respect to the actuator, which relative movement is produced during operation of the internal combustion engine, can be minimized.

According to a further aspect, the axial lock is a slotted guide which runs radially around the camshaft with a first and a second slotted guide track which are axially adjacent with respect to one another and into which a locking element which is prestressed by way of a spring engages.

Simple switching of the switching camshaft with simultaneous locking in the end positions is possible by way of the first and second slotted guide tracks being spaced apart from one another via a cylindrical section.

According to a further aspect, the first and second slotted guide tracks in each case enclose an opposite angle of between 2° and 45° with a camshaft access.

Advantageously, friction is minimized in that the slotted guide mounted on the camshaft with an anti-friction bearing or a plain bearing.

The switching operation is simplified considerably and the wear is minimized in that the slotted guide has an axial groove over the slotted guide tracks and the cylindrical section.

Other objects, advantages and novel features of the present invention will become apparent from the following detailed description of one or more preferred embodiments when considered in conjunction with the accompanying drawings.

In the following text, the same designations apply to identical components in FIGS. 1 to 5.

DETAILED DESCRIPTION OF THE DRAWINGS

Figure 1:
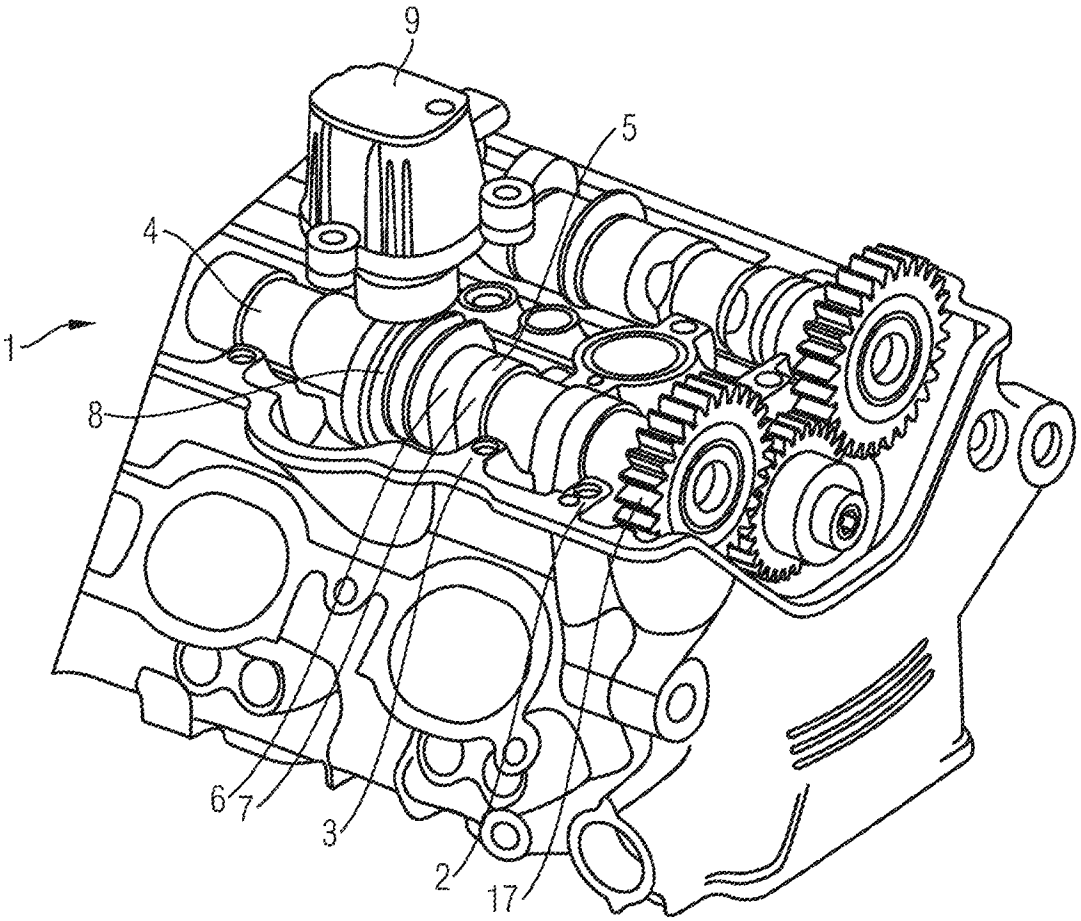
FIG. 1 is a plan view of a valve drive according to an embodiment of the invention.
Figure 2:
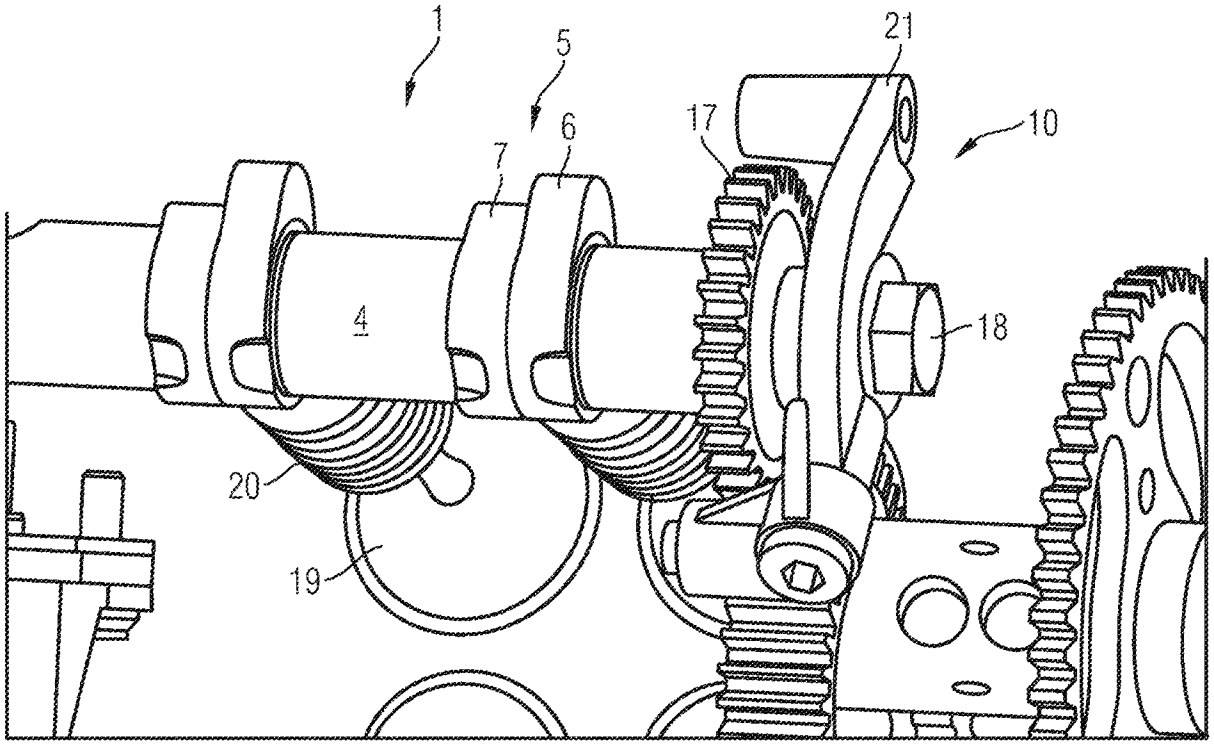
FIG. 2 is a plan view of the valve drive with a locking apparatus.

FIG. 1 shows a plan view of a valve drive 1 for a cylinder head of an internal combustion engine. The cylinder head (without designation) is shown without a valve cover, in order that the valve drive 1 is visible. The valve drive 1 is arranged on the inlet side and is provided for two cylinders with four gas exchange valves of identical action which are shown in FIG. 2.

The valve drive 1 has a first camshaft 4 which is mounted rotatably in a first and a second camshaft bearing 2, 3 and in further camshaft bearings that are not designated. A second camshaft without designation is provided on the outlet side. In the present exemplary embodiment, the first camshaft 4 has four cams 5 for four gas exchange valves (not shown) for two cylinders of the internal combustion engine, only one cam 5 being designated. The cam 5 has a first cam lobe 6 (curve) and a second cam lobe (curve) 7 which is different than the first cam lobe 6. During the operation of the internal combustion engine, the gas exchange valve can be actuated either by the first or by the second cam lobe 6, 7 via an intermediate element, such as a sliding rocker arm.

Furthermore, a camshaft section 8 is provided, with radially outwardly circumferential control grooves, into which a pin (not visible) of an actuator 9 engages, with the result that the camshaft 4 can be displaced with the cam 5 in such a way that the gas exchange valve can be actuated either via the first or the second cam lobe 6, 7.

The camshaft 4 and the cam 5 are preferably made from the same material and in one piece. In a further embodiment, the cam can also be shrink-fitted or joined onto the camshaft 4. A spur gear wheel 17 which can be driven by a further gearwheel without designation is provided for driving the camshaft 4.

In order to reduce the load of the pin of the actuator 9 during the operation of the internal combustion engine, an axial lock 10 which is shown in the following figures is provided for the axially displaceable camshaft 4.

Figure 4:
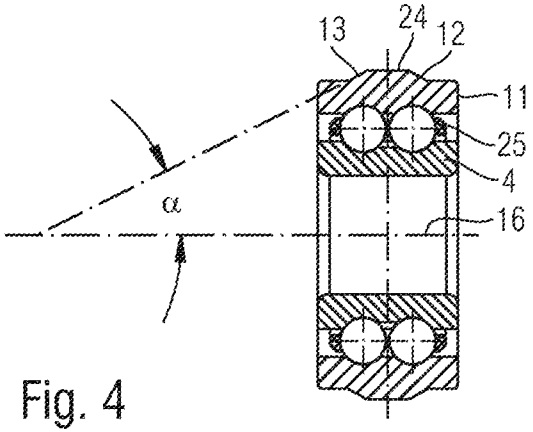
FIG. 4 is a section through the axial lock.

FIG. 2 shows a plan view of the axial lock 10 for the first camshaft 4. In FIG. 2, the first camshaft 4 has two cams 5, only a single cam 5 once again being designated. The first cam lobe 6 and the second cam lobe 7 which is different than the first cam lobe 6 can be seen clearly in FIG. 2. Gas exchange valves 19 can also be seen in the illustration in FIG. 2, with in each case one valve spring 20, of which gas exchange valves 19 in each case only one is designated. A drive gearwheel, the spur gear wheel, for the camshaft 4 is in turn designated by 17. The axial lock 10 is a slotted guide 11 which is shown in FIG. 4, runs radially around the camshaft 4, and has a first and a second slotted guide track 12, 13 which are axially adjacent with respect to one another and into which a locking element 15 which is prestressed by way of a spring 14 engages. The locking element 15 which is prestressed by way of the spring 14 is arranged in a bracket 21. The axial lock 10 is mounted onto the first camshaft 4 by way of a screw connection 18.

Figure 3:
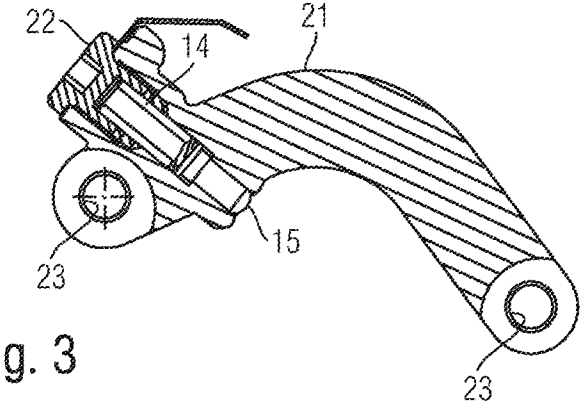
FIG. 3 is a section through a locking element of the axial lock.

FIG. 3 shows a section through the bracket 21 with the locking element 15 which is prestressed by way of the spring 14. The bracket 21 has two fastening bores 23. The locking element 15 is a pin which is prestressed by way of the spring 14, it being possible for the prestress to be set by way of a cap nut 22.

FIG. 4 shows a section through the axial lock 10 without the prestressed locking element 15. The slotted guide 11 with the first and the second slotted guide track 12, 13 which are axially adjacent with respect to one another is mounted radially on the camshaft 4 in the present exemplary embodiment via an anti-friction bearing 25, a ball bearing in the present exemplary embodiment. It can also be a plain bearing in another exemplary embodiment. A camshaft axis is denoted by 16. An angle between the second slotted guide track 13 and the camshaft axis 16 is denoted by a. Furthermore, in the present exemplary embodiment, the first and the second slotted guide track 12, 13 are spaced apart axially from one another by way of a cylindrical section 24. The first and the second slotted guide track 12, 13 preferably form an angle of between 2° and 45° with the camshaft axis 16.

Figure 5:
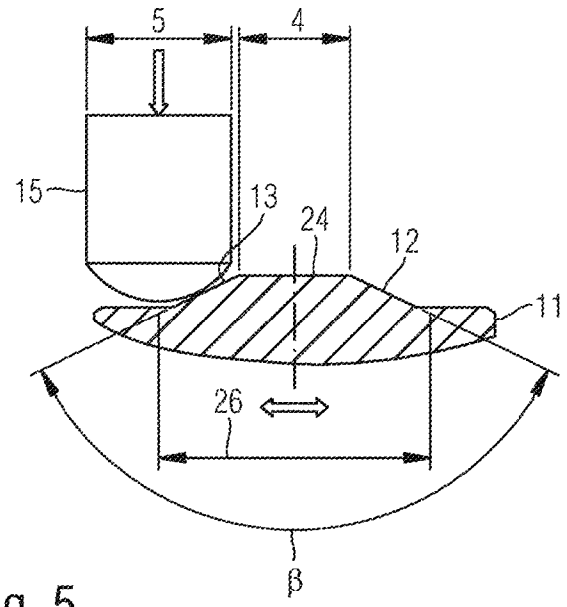
FIG. 5 is a section through the locking element in an operative connection with the axial lock.

FIG. 5 shows a section through the locking element 15 and the slotted guide 11. The prestress by way of the spring 14 is shown by way of an arrow onto the locking element 15 in the direction of the slotted guide 11. A displacement travel of the locking element 15 over the slotted guide 11 is denoted by 26. The displacement travel 26 corresponds to the width of a cam lobe 6, 7. An angle between the slotted guide tracks 12, 13 is denoted by β.

In a further particularly preferred exemplary embodiment, the slotted guide 11 has an axial groove over the slotted guide tracks 12, 13 and the cylindrical section 24, in which axial groove the locking element 15 can be displaced axially.

A relative movement which is produced of the first camshaft 4 with respect to the pin of the actuating element 9 can be minimized by way of the use of the axial lock 10 according to the invention. This makes a single-piece sliding camshaft possible.

LIST OF DESIGNATIONS

1 Valve drive
2 First camshaft bearing
3 Second camshaft bearing
4 First camshaft
5 Cam
6 First cam lobe (curve)
7 Second cam lobe (curve)
8 Camshaft section
9 Actuator
10 Axial lock
11 Slotted guide
12 First slotted guide track
13 Second slotted guide track
14 Spring
15 Locking element
16 Camshaft axis
17 Spur gearwheel
18 Screw connection
19 Gas exchange valve
20 Valve spring
21 Bracket
22 Cap nut
23 Fastening bore
24 Cylindrical section
25 Anti-friction bearing
26 Displacement travel
α Angle between the camshaft axis and the slotted guide track
β Angle between the slotted guide tracks The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A valve drive for a cylinder head of an internal combustion engine, the valve drive comprising:

a first camshaft mounted rotatably in first and second camshaft bearings, the first camshaft including:

at least one cam with a first cam lobe and a second cam lobe different from the first cam lobe, the first cam lobe and the second cam lobe are configured to alternately actuate a gas exchange valve, and a camshaft section configured to axially displace the at least one cam via an actuator such that a selected one of the first cam lobe and the second cam lobe actuates the gas exchange valve; and an axial lock operatively coupled with the first camshaft, the axial lock comprises a slotted guide that runs around an outer circumference of the first camshaft, the slotted guide including a first slotted guide track and a second slotted guide track axially adjacent one another via an interposed cylindrical section, and an axial groove over the first and second slotted guide tracks and the cylindrical section, wherein the at least one cam is fixed on the first camshaft, and wherein the first camshaft is configured to be axially displaced in the first and the second camshaft bearing, and wherein a locking element is configured to alternately engage the first and the second slotted guide tracks.

2. The valve drive according to claim 1, wherein the locking element is prestressed toward the slotted guide via a spring.

3. The valve drive according to claim 2, wherein the first and the second slotted guide tracks each form an angle between 2° and 45° with respect to an axis of the first camshaft.

4. The valve drive according to claim 2, wherein the slotted guide is mounted on the first camshaft via an anti-friction bearing or a plain bearing.

* * * * *